US006006380A

United States Patent [19]

Sramek

[11] Patent Number: 6,006,380

[45] **Date of Patent: *Dec. 28, 1999**

[54] ADJUSTABLE CERVICAL PILLOW WITH DEPRESSIONS FOR A USER'S EAR

[75] Inventor: Roger Sramek, San Francisco, Calif.

[73] Assignee: Les Nuages, LLC, San Francisco, Calif.

[ * ] Notice: This patent is subject to a terminal disclaimer.

[21] Appl. No.: 09/098,243

[22] Filed: Jun. 17, 1998

Related U.S. Application Data

[63] Continuation-in-part of application No. PCT/US97/20141, Nov. 11, 1997, which is a continuation-in-part of application No. 08/747,482, Nov. 12, 1996, Pat. No. 5,781,947.

[51] Int. Cl.[6] ..... A47G 9/00

[52] U.S. Cl. ..... 5/636; 5/640

[58] Field of Search ..... 5/636, 640, 637, 5/643, 644, 722; D6/601

[56] References Cited

U.S. PATENT DOCUMENTS

| | | | |
|---|---|---|---|
| 220,823 | 5/1879 | Howe et al. . | |
| 256,728 | 9/1882 | Allen . | |
| D. 385,741 | 11/1997 | Lebenbaum | D6/601 |
| 2,835,905 | 5/1958 | Tomasson | 5/636 |
| 3,009,172 | 11/1961 | Eidam . | |
| 3,141,179 | 7/1964 | McLean | 5/640 |
| 3,276,046 | 10/1966 | Capelli | 5/636 |
| 3,315,282 | 4/1967 | Lowery et al. . | |
| 4,118,813 | 10/1978 | Armstrong | 5/636 |
| 4,788,728 | 12/1988 | Lake | 5/490 |
| 4,908,843 | 3/1990 | Smit | 5/636 |
| 4,908,894 | 3/1990 | Sanders | 5/636 |
| 5,018,231 | 5/1991 | Wang . | |
| 5,088,141 | 2/1992 | Meyer et al. | 5/636 |
| 5,163,194 | 11/1992 | Dixon | 5/636 |
| 5,528,784 | 6/1996 | Painter | 5/640 |

*Primary Examiner*—Alexander Grosz

*Attorney, Agent, or Firm*—Townsend and Townsend and Crew LLP

[57] ABSTRACT

An adjustable cervical pillow, with beautification properties, for supporting the head and neck of a person. The cervical pillow includes a resilient pillow body with a resilient upper portion that includes a plurality of depressions on a top face of the resilient upper portion for receiving a person's ear during use. The pillow body further includes a central depression and at least one head adjusting shim. The top face includes a raised cervical support region for supporting the neck of a user during use.

18 Claims, 6 Drawing Sheets

ADJUSTABLE CERVICAL PILLOW WITH DEPRESSIONS FOR A USER'S EAR

CROSS REFERENCE TO RELATED APPLICATIONS

This application is a continuation-in-part of PCT/US 97/20141 (designating the United States) by Roger Sramek filed Nov. 11, 1997, which is a continuation-in-part of U.S. Ser. No. 08/747,482, now U.S. Pat. No. 5,781,947 by Roger Sramek filed on Nov. 12, 1996. The present application is entitled to priority to PCT/US 97/20141 and U.S. Ser. No. 08/747,482, now U.S. Pat. No. 5,781,947, and claims priority thereto. Furthermore, specifications of PCT/US 97/20141 and U.S. Ser. No. 08/747,482 now U.S. Pat. No. 5,781,947 are incorporated herein by reference in their entirety for all purposes.

FIELD OF THE INVENTION

The present invention relates to a pillow for sleeping having therapeutic and cosmetic properties.

BACKGROUND OF THE INVENTION

Standard solid-bodied pillows in common use for many years have a number of limitations. The downward force caused by the weight of a person's head on tissue and facial skin in contact with solid bodied pillows is considerable, causing local stretching and deformation of the skin. Over a period of many years this deformation accelerates wrinkling of the skin, contributing to the visible effects of ageing.

Similarly, the outer surfaces of the ears are crushed by the weight of the head when a person using a pillow lies to the side, contributing to the incidence of bacterial and fungal ear infections, morning wax deafness, ear ache and gradual deformation and wrinkling of the pinna.

In addition, standard pillows provide uneven support to the head and neck, causing muscular strain of the neck and back, and causing general night unrest. Sleepers adopt a side or face down position during sleep in an effort to conform to the support points of a pillow, spending disproportionately little time sleeping in a supine position. This can accelerate degeneration of the spine associated with ageing, particularly in the neck region. Indeed, neck injury commonly results from improper support while sleeping. Similarly, in an attempt to match personal anatomy to a pillow, many people adopt unnatural sleeping positions with arms and hands used to provide head support, which leads to discomfort and joint degeneration, and even arthritis, in the hands, elbows and shoulders.

Finally, although a variety of pillow sizes and shapes are available, they can not be specifically customized to match an individual's anatomy and natural sleep habits.

In an attempt to address some of these deficiencies, various pillow designs have been proposed. Wang, U.S. Pat. No. 5,018,231 describes a pillow with a neck support and groves to reduce ear compression when lying to the side. However, the groves of the Wang design poorly distribute weight away from the ear, because the head and face is supported only above and below the ear. Indeed, this general lack of facial support increases the pressure on the face of the user at the few points which contact the pillow, potentially causing discomfort, skin damage and the like. In addition, the entire pillow is of a single piece, which prevents customization of the pillow by a user. Furthermore, nothing in the pillow design addresses the general formation of facial wrinkles or pressure creases from facial compression. Indeed, it seems likely that morning wrinkles would form on a sleeper's face along the lines of the grooves.

Lake, U.S. Pat. No. 4,788,728 describe a pillow with a shaped central depression. Like Wang, when sleeping with one's face to the side, this pillow redistributes weight to only a few regions of the face, potentially damaging these regions and causing morning wrinkling and discomfort. Furthermore, the pillow is not customizable.

The present invention solves these and other problems.

SUMMARY OF THE INVENTION

The present invention provides a pillow which reduces the incidence of morning wrinkles and permanent skin wrinkling, which prevents ear compression and which provides anatomically correct and adjustable cervical and head support.

The cervical pillow with beautification properties for supporting the head and neck of a person of the invention has a resilient pillow body with an adjustable height head rest. The resilient pillow body has a resilient upper portion with a plurality of depressions on a top face of the resilient upper portion for receiving the person's ears. The top face includes a substantially planar portion with a downward angular planar declination, which may be integral or the result of conforming the pillow body to a sloped supporting pillow shim. Ideally, the downward angle of declination is between about 2° and about 6°. It will be appreciated that the planar portion can be moderately curved or connected to a region of moderate curvature.

The resilient pillow body also has a resilient lower portion with a bottom face. This lower resilient portion is optionally integral with the top resilient portion, or it is optionally laminated onto the resilient upper portion. The lower resilient portion is optionally constructed of a different material than the upper resilient portion, e.g., in one embodiment, the upper resilient portion is optionally constructed from a flexible urethane foam of a different density, indentation force deflection, modulus, or rebound than the resilient lower portion.

The pillow optionally includes a resilient pillow height adjustment shim under the bottom face of the resilient lower portion of the resilient pillow body for raising the pillow body. In one embodiment, the resilient pillow height adjustment shim has an inclined surface which provides the angular planar declination to the top face of the resilient upper portion of the resilient pillow body. This is accomplished by allowing the resilient upper portion to conform to the inclined surface on the resilient pillow height adjustment shim. In other embodiments, the angular planar declination on the top face of the resilient upper portion of the resilient pillow body is integral to the top face. In some embodiments, more than one pillow height adjustment shim is used to adjust the overall height of the resilient pillow body.

The adjustable height head rest typically includes a central depression in the pillow body and a plurality of head-height adjustment shims which fit into the central depression. Ordinarily, the central depression and/or the shims have a raised portion for supporting the neck. Optionally, the head height adjustment shims are of varying thickness, increasing the selection options for the height of the adjustable height head rest. In preferred embodiments, the head height adjustment shim which comes into contact with a person's head is contoured to fit the person's head. In one preferred embodiment, the cervical pillow of the invention has three adjustable head height adjustment shims of varying thickness with a top height adjustment shim contoured to fit the person's head. In another preferred embodiment, the head height adjustment shims are located under the pillow body in the region giving cervical support. By using shims of varying thickness, a greater variety of adjustments are possible with a set number of shims.

In preferred embodiments, the top surface of the upper resilient portion comprises a rounded edge around the circumference of the pillow. In particularly preferred embodiments, the top surface of the upper resilient portion comprises a resilient raised region for supporting the neck of the person when the ears of the person are positioned in the depressions for receiving the person's ears.

In one preferred embodiment, the head height adjustment shim is located under the upper resilient portion in a region which increases or decreases the amount of neck support experienced by the user (thereby raising or lowering the head and neck). Typically, multiple removable shims are used to provide for customization by the user.

The pillows of the invention are typically made from urethane foam, although other resilient man made and natural materials are also appropriate. Commonly, the urethane foam is shaped into pillow components using a cavity molding or free-rise molding process, or by cutting a foam blank to a desired size and shape. Examples of foams used for the pillow components of the invention include standard polyurethane foams, and classes of foams such as TEMPER FOAM®, MEMORY FOAM®, MEMORY FLEX® and VISCO ELASTIC®.

In preferred embodiments, the pillows of the invention have an absorptive pillow covering encasing the pillow body. This absorptive covering can be made from a bacteriocidal fabric such as STAPH-CHECK®. The pillow, with or without an absorptive covering is often used in conjunction with a loose-fitting pillow case. In one embodiment, the pillow case is made from a silk fabric.

The present invention also provides methods of making cervical pillows with beautification properties for supporting the head and neck of a person. In the methods of the invention, a resilient pillow body with an adjustable height head rest from a polyurethane foam is formed, e.g., using a molding or cutting process. The resilient pillow body is shaped to have a resilient upper portion with a plurality of depressions on a top face of the resilient upper portion for receiving a person's ears. The top face is also shaped to have a planar portion with a downward angular planar declination. Finally, the resilient pillow body is shaped to have a resilient lower portion with a bottom face. Methods of shaping and forming urethane include, inter alia, injection molding, cavity molding, die cutting, and hand cutting.

DESCRIPTION OF THE PREFERRED EMBODIMENTS

Figure 1:
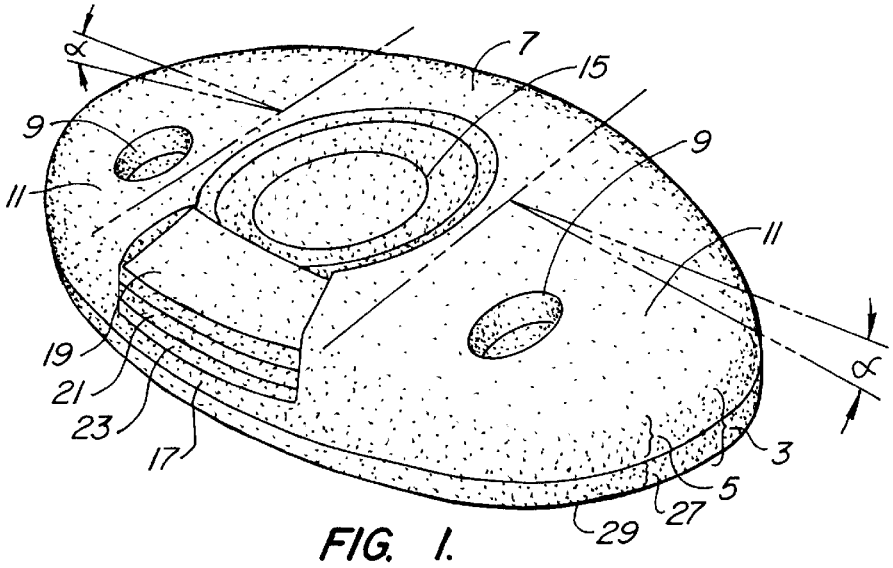
FIG. 1 is a perspective drawing of a pillow of the invention shown from the top.

The pillows of the invention provide enhanced cervical and cosmetic properties when compared to a standard pillow. The pillows are easily customized and configured for optimal comfort, typically having overall pillow height adjustments, and head-height adjustments.

The pillows of the invention are optionally made from one or more of a variety of resilient pillow materials, such as man-made plastic foams (e.g., polyurethanes), feathers (e.g., goose or chick down) or natural fibers (e.g., cotton, kapok or the like). Most typically, the pillows of the invention are made from resilient urethane foams e.g., by molding polyurethane in a cast, or cutting the polyurethane from a larger polyurethane foam blank. "Resilient" pillow component materials as used herein means that the material used in the construction of the pillow component compresses or flexes with the application of pressure (e.g., the weight of a person's head applied to the component during use), and that the component tends to return to approximately the same shape when the pressure is removed from the component. Materials with shape memory i.e., which retain the shape of a pressure imprint for a time, slowly returning to approximately the shape of the component prior to the application of pressure are considered "resilient" materials for purposes of this disclosure. Examples of such materials include polyurethane foam components which conform to a person's head or face at body temperature, but which gradually return to an original shape after the person's head or face is removed from the component and the component cools to room temperature. Similarly, down or natural fiber pillow components which are quilted or packed to retain a given shape are "resilient" materials for purposes of this disclosure.

It is expected that one of skill is fully aware of manufacturing methods for making and shaping resilient polyurethane foams. A general introduction to manufacture of plastics in general, and urethane foams in particular is found in *Kirk-Othmer Encyclopedia of Chemical Technology* third and fourth editions, esp. volumes 18 and volume 23, Martin Grayson, Executive Editor, Wiley-Interscience, John Wiley and Sons, NY, and in the references cited therein ("Kirk-Othmer").

Resilient flexible urethane foams are typically processed into pillow components, or blanks from which these components are cut using known techniques. These techniques can include, e.g., free rise processing, extrusion, cavity molding, injection molding, structural foam molding, rotational molding, thermoforming, calendaring, thermosetting, reaction injection molding, and the like. See, Kirk-Othmer, supra. The physical properties of urethane foams such as indentation force deflection (IFD), modulus (i.e., Young's modulus; stress=force/area; the resulting relative change in size is termed strain and the modulus of elasticity=stress/strain) and rebound depend on, e.g., the density of the foam, the catalyst used to set the foam, the presence of surfactant in the foam, the presence of polyols and isocyanates and the type of mixing. A variety of manufacturing techniques are known for both thermoplastic and thermosetting urethanes, and polyurethanes and associated solvents, reagents, catalysts and the like are commercially available from J. P. Stevens (East Hampton, Ma.) as well as other commercial sources such as Akzo, BASF, Dow, Mobay, Olin, Rubicon, Upjohn, Bayer, Takeda, Veba, Eastman, Sun Oil, and other manufacturers known to persons of skill. See also, Kirk Othmer, id.

For example, in the free rise process, the chemical components of the urethane foam are mixed in a vat where they foam and rise. Bales of the foam are cut into blanks and milling is performed using a cutting tool such as a contour cutter (or, optionally, by hand cutting the blank). In the cavity molding process, a shaped cavity is made, e.g., from fiberglass or aluminum. The chemical components of the urethane foam are sprayed into the shaped cavity, where they expand to fit the shaped cavity. The cavity is then opened, and the shaped foam is released.

Typically, the polyurethane foams used in the pillows are of a suitable density and compressibility to support a human head, which typically weighs between about 9 and about 15 pounds. Typically, the resilient upper portion of the pillows of the invention are fabricated from a high density, high quality urethane foam. Preferably, the urethane foam used in the upper portion of the pillow also conforms to the head and face of the user upon the application of body heat. One of skill can make such foams using known techniques, and several suitable classes of foams are commercially available, such as TEMPER FOAM® (available, e.g., from Kees Goebel Medical, Hamilton, Ohio), MEMORY FOAM®, MEMORY FLEX®, and VISCO ELASTIC® (all available from North Carolina Foam, Inc., Mount Airy, N.C.). To save on manufacturing costs, a urethane foam which is optionally less dense, and/or which does not conform to the user upon the application of body heat is optionally used for the lower components of the pillow (overall pillow height adjustment shims and the like, as set forth herein) which do not typically come in contact with the user's head or face.

FIG. 1 is a perspective illustration of a preferred exemplar embodiment for a cervical pillow of the invention with beautification properties for supporting the head and neck of a person. As described in more detail below, cervical beautification pillow 1 comprises resilient pillow body 3 with features for improving comfort and countering the effects of the natural ageing process in the skin of the user.

Resilient pillow body 3 includes resilient upper portion 5 having top face 7 with at least one, and typically two or more ear depressions 9 for receiving the person's ears when the person is lying on their side.

Figure 4:
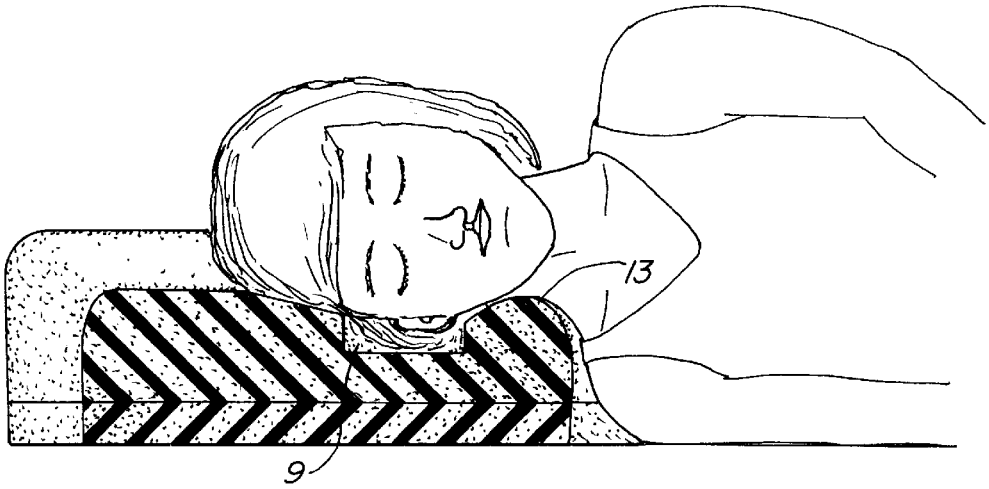
FIG. 4 is a cutaway drawing of a pillow of the invention showing a raised cervical support region with a person lying to the side on the pillow.

FIG. 4 shows a cutaway drawing of a person lying on their side on cervical beautification pillow 1. By placing an ear in depressions 9 while sleeping, a user enjoys several benefits over conventional pillows. First, the user's ear is not flattened while sleeping, which slows distortion and wrinkling of the pinna (outer ear) experienced both as a result of ageing and from progressive damage caused by sleeping on conventional pillows. Second, ear plugs can be worn with greater comfort, because the ear plug is not forced into the ear canal by the pressure of the user lying with their face to the side. Third, water can drain more easily from the ear, preventing external otitis ("swimmers ear") in the ear canal commonly experienced by users who shower before going to sleep, as well as preventing more serious ear infections which can result from external otitis. Fourth, because the outer ear is not distorted relative to the middle ear, morning wax deafness is reduced. Fifth, because the user's hands are not needed to prop the face into a position which reduces pressure on the ear, shoulder and neck stiffness and discomfort are reduced. Further in this regard, the temperature of the face is reduced by being placed directly on the pillow surface, rather than on the user's hands. This reduces the incidence of bacteria, as well as the transfer of bacteria and skin oils from the hands to the face, thereby reducing acne and more serious skin infections. Sixth, because the ear is not crushed between the head of the user and a flat pillow surface, the user experiences greater comfort. Seventh, grinding and clenching of teeth due to dislocation of the jaw at the temporomandibular joint is prevented by reducing the pressure on the condyle of the jaw bone (a person tends to clench the jaw to offset the pressure imposed on the condyle by a standard flat pillow surface). Eighth, ear depression 9 reduces distortion of the entire face when the ear is placed in the depression, thereby reducing morning wrinkling of the face. Further in this regard, because the lips of the user are not as distorted by cervical beautification pillow 1 as they are when using a standard pillow, the tendency to drool while asleep is reduced. Finally, in contrast to Wang, supra, the face is fully supported around ear depression 9, preventing overcompression of a single portion of the face. Other advantages will also be apparent upon viewing the present disclosure.

Returning to FIG. 1, top face 7 also includes one or more downward sloping planar portions 11 with a downward angular planar declination angle $\alpha$, measured from horizontal. This angle, as described supra, is typically between about 1 and 15°, i.e., downward sloping portion 11 of the pillow face slopes downward from the horizontal at angle $\alpha$ between about 1° and about 15°. Downward sloping planar portion 11 with downward angular planar declination angle $\alpha$ provides the user with several benefits. For example, the appearance of morning wrinkles on the skin of the user's face due to stretching of the face from the weight of the user's head pressing ventrally downward are reduced, because the skin is not pulled ventrally. Instead, the skin and flesh on the users face is gently drawn in a dorsal direction, thereby offsetting the ventral pull of gravity and returning the skin on the user's face (e.g., around the skin and eyes) to a neutral position. Similarly, because the nasal passages are pulled slightly open by the gentle dorsal pull on the skin, rather than being pushed closed by the ventral pull of an ordinary pillow, sinus congestion is reduced. This prevents sinus infections and reduces snoring. Because airways are pulled open, obstructive sleep apnea (a potentially serious sleeping disorder often caused by the collapse of the central airways in overweight or elderly persons during sleep, causing sputtering, snorting and snoring during sleep) is reduced. Finally, because a user sleeping with their stomach on the surface of a bed does not have to turn their neck a full 90 degrees to rest their head on the pillow, neck and back strain are reduced. Typically, $\alpha$ is a gentle to moderate downward angle from the horizontal, varying between about 1 and about 15 degrees. More typically, $\alpha$ will be between about 2 degrees and about 6 degrees. Generally, $\alpha$ will be between about 3 degrees and about 5 degrees. For example, in one preferred embodiment, $\alpha$ is about 4 degrees.

FIG. 4. depicts an optional neck support feature of cervical beautification pillow 1. In particular, top face 7 further comprises rolled neck support surface 13 for supporting the neck of a sleeper when lying to the side.

Figure 2:
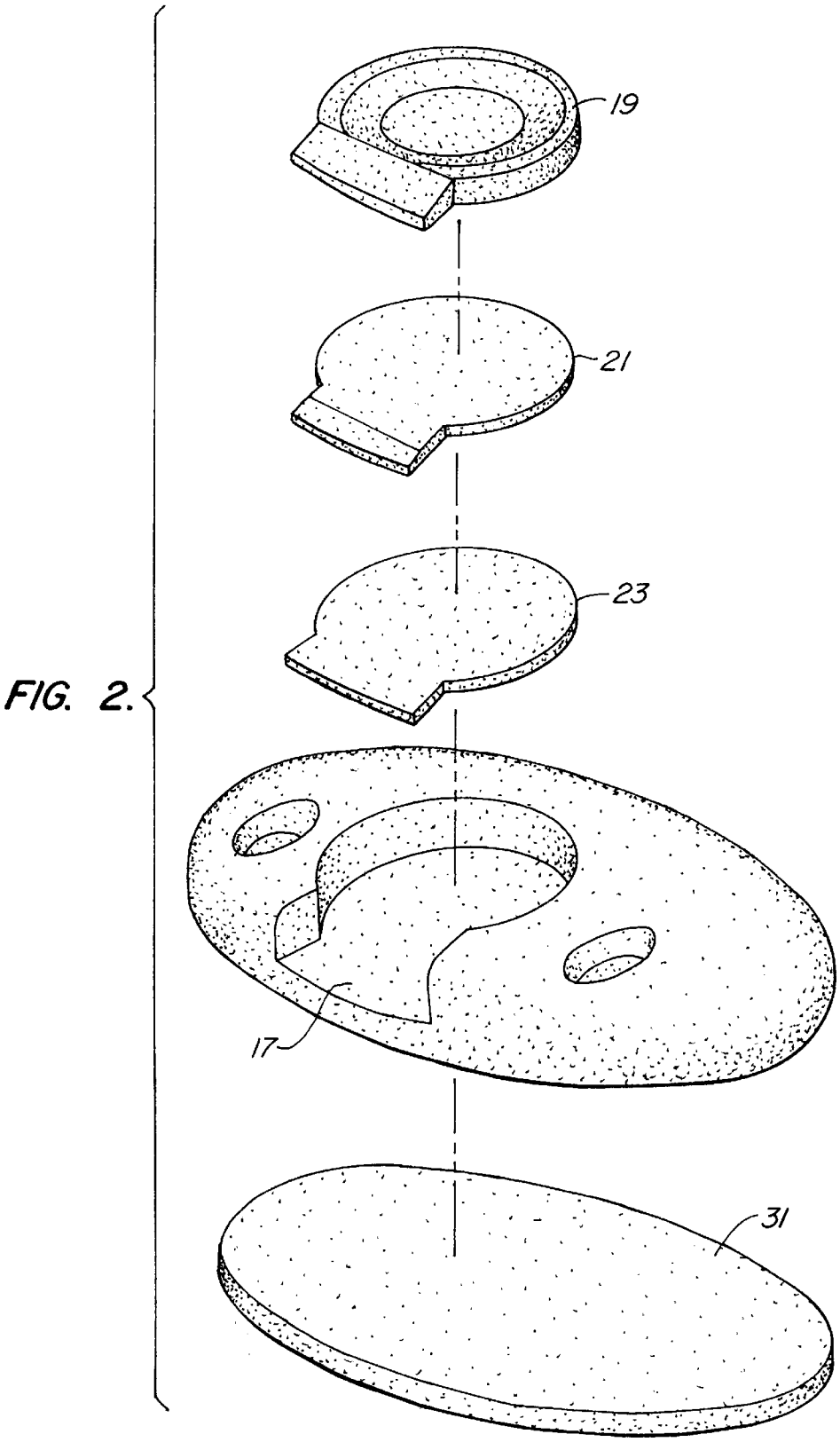
FIG. 2 is an expanded view of a pillow of the invention, showing details of an adjustable height head rest.

FIG. 2 provides details of adjustable height head rest 15. Central depression 17 with top head height adjustment shim 19, intermediate head height adjustment shim 21 and lower head height adjustment shim 23 are adjusted to support the head and neck of a person using the cervical pillow.

Although it is not required, top head height adjustment shim 19 is preferably contoured to support the occipital region of the head when the user sleeps with their dorsal surface on the bed. The contour of top head height adjustment shim 19 reduces pressure on the occipital condyle at the base of the skull, improving the comfort of the pillow, and reducing the incidence of headache. In addition, by contouring top head height adjustment shim 19 to the user's head, the user's ears are lowered relative to the height of the pillow, thereby acoustically reducing the sound experienced by the user and facilitating meditation and sleep. The contour in top head height adjustment shim 19 also reduces side to side movement of the head, aiding in relaxation of the neck. However, the sides of the contour are preferably at a moderate angle relative to the center of the contour, permitting a user a moderate degree of freedom in moving their head from side to side. It will be appreciated that a full 90 degree angle to the sides of the contour more completely restricts side to side head motion. In some cases, e.g., where a user suffers from a neck injury, a greater restriction on side to side motion and a 90 degree angle to the sides of the contour is desirable.

Figure 3:
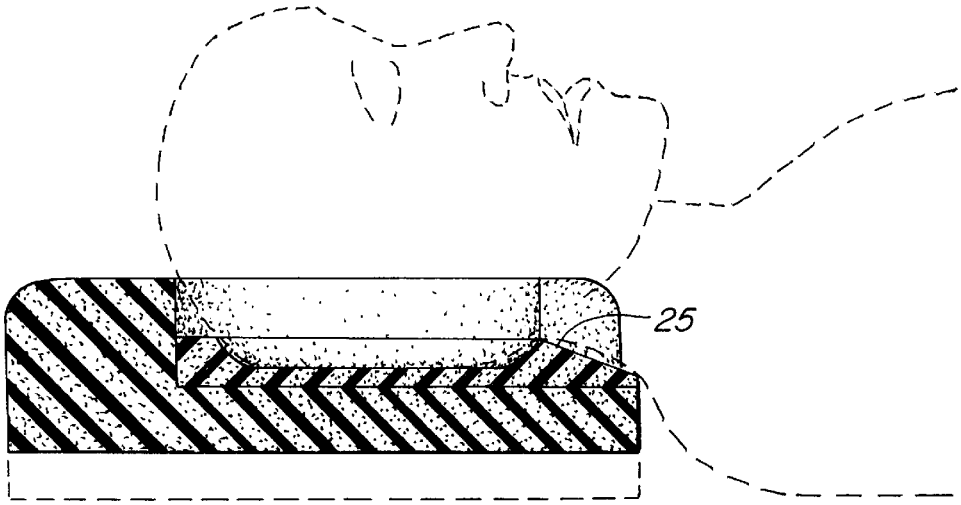
FIG. 3 is a cutaway drawing of a pillow of the invention showing a raised cervical support region with a person lying supine on the pillow.

As depicted in FIG. 3, The contour on top head height adjustment shim 19 optionally includes raised cervical support region 25 for supporting the base of the skull and neck. In addition to providing support, this raised cervical support region provides mild traction to the neck, gently stretching the neck and improving the overall comfort to the user. By extending or decreasing the size of support region 25, the amount of traction can be optimized for a particular user.

Although FIG. 2 provides details for three head height adjustment shims for exemplary purposes, it will be appreciated that more or fewer shims are optionally included with the pillow, and that typically only a subset of the shims are needed by a particular user. Typically, at least one head height adjustment shim is included with the pillow for selection by the user, ordinarily two or more head height adjustment shims are included, more typically three head height adjustment shims are included and sometimes four or more head height adjustment shims are included. The user's personal preferences, size, overall pillow dimensions, bed firmness, pillow firmness and any medical conditions are used to determine the proper number and height of the shims which are used.

The head height adjustment shims are optionally of differing thicknesses, thereby increasing the possible height adjustment options for the user. In one embodiment, a variety of head height adjustment shims are provided with a pillow body to the user, with the user selecting the head height adjustment shims based upon personal preference. In other embodiments, the pillow body and head height adjustment shims are optimized for a particular size of user (e.g., several masculine and feminine pillows are customized by size for small, medium, large, and very large users). In still other embodiments, pillows are customized to a particular person using a large selection of head height adjustment shims which are optionally provided separate from the pillow body. It will be appreciated that the shims can also provide for greater or lesser cervical traction depending not only upon the thickness of the shims, but also upon the length of the shims as measured from the front (or cervical support region) of the pillow towards the rear of the pillow.

By increasing the comfort for a user of sleeping on the user's back by optimizing the user's head height as described above, the user increases time spent sleeping supine. This, in turn, reduces the stress experienced by the user's ventral surfaces. In addition, it was found that properly adjusting the user's head height reduced snoring usually experienced by users sleeping supine.

As shown in FIG. 1, resilient lower portion 27, including bottom face 29 provides the lower portion of resilient pillow body 3. As shown in FIG. 2, in some embodiments, bottom face 29 is optionally set on top of pillow height adjustment shim 31. Shim 31 allows the user to increase the overall height of the pillow, making the pillow more comfortable for larger users (and/or users with firmer mattresses). Resilient lower portion 27 is optionally integrally molded with upper resilient portion 5, i.e., where pillow body 3 is formed from a single piece of material (typically a urethane foam). In certain embodiments, resilient lower portion 27 and upper resilient portion 5 are molded separately, and laminated together, e.g., using an adhesive. Where resilient lower portion 27 and upper resilient portion 5 are molded separately, it is advantageous in some embodiments to form lower portion 27 from a less expensive material than upper resilient portion 5, as the lower portion does not contact the user's head or face in ordinary use. For example, upper resilient portion 5 is optionally formed from a high density polyurethane foam such as TEMPER FOAM®, MEMORY FOAM®, MEMORY FLEX®, or VISCO ELASTIC®, with lower portion 27 being formed from a less expensive standard urethane foam. In this embodiment, the overall deformability of the pillow is adjusted, e.g., by selecting more or less dense urethane foams for either upper resilient portion 5 or lower portion 27, or both.

For exemplary purposes, a single pillow height adjustment shim 31 is shown in FIG. 2. It will be appreciated that multiple shims, optionally of differing thicknesses are optionally packaged with pillow body 3 for selection by a user. One of skill will recognize that just one or a few pillow height adjustment shims in conjunction with, e.g., top head height adjustment shim 19, intermediate head height adjustment shim 21 and lower head height adjustment shim 23, e.g., where shims 19, 21 and 23 are of differing thickness, provides many different overall height adjustments for the resting height of a user's head. For example, eight separate head height settings are possible in adjustable height head rest 15 alone using just shims 19, 21 and 23, where each of the shims are of a different thickness. Combinations include: (i) no shims; (ii) top head height adjustment shim 19; (iii) intermediate head height adjustment shim 21; (iv) lower head height adjustment shim 23; (v) top head height adjustment shim 19+intermediate head height adjustment shim 21; (vi) top head height adjustment shim 19+lower head height adjustment shim 23; (vii) top head height adjustment shim 19+intermediate head height adjustment shim 21+lower head height adjustment shim 23; and, (viii) intermediate head height adjustment shim 21+lower head height adjustment shim 23.

Figure 5:
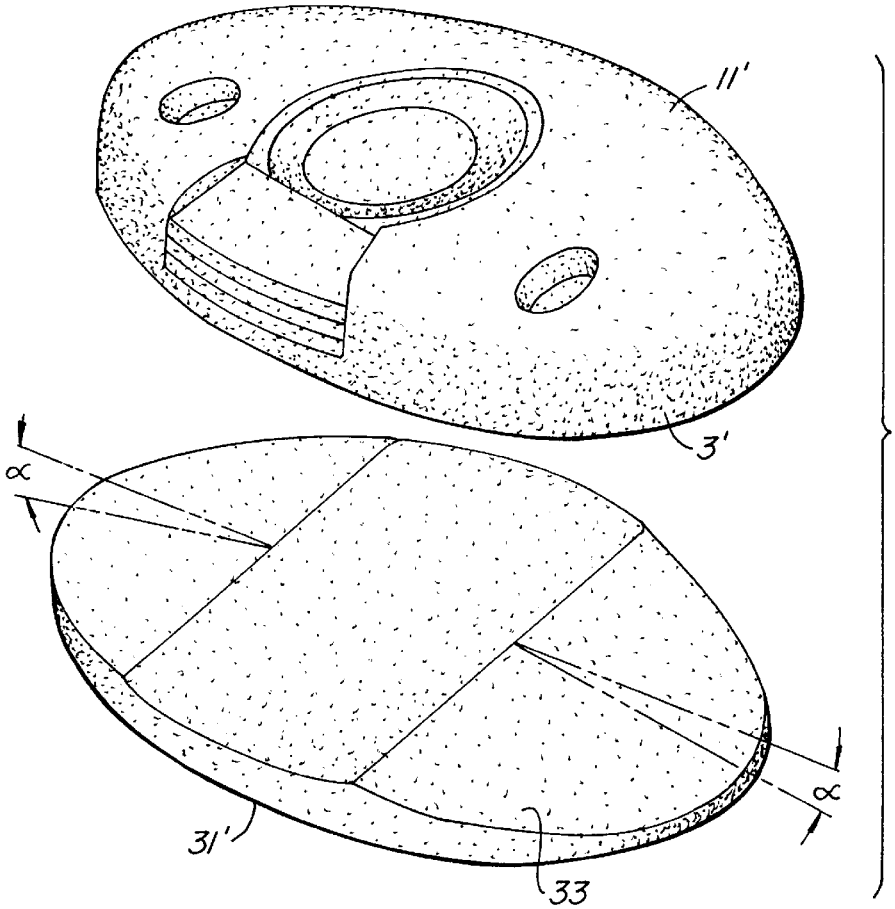
FIG. 5 is an expanded view of a pillow of the invention with a lower shim including an inclined face.

In one class of embodiments depicted in FIG. 5, alternate pillow height adjustment shim 31' comprises planar inclined face 33. In this embodiment, alternate pillow body 3' conforms to alternate pillow height adjustment shim 31' and planar inclined face 33 to provide the downward angular planar declination angle α on alternate top face 5', i.e., top face 5' is molded without an integral downward sloping planar portion 11 as in the embodiment shown in FIG. 1; instead, conformation of alternate pillow body 3' to planar inclined face 33 provides alternate top face 5' with a downward sloping portion having declination angle α (i.e., alternate pillow body 3' bends in the middle to conform to planar inclined face 33). This embodiment provides for simplified manufacturing, particularly where alternate pillow height adjustment shim 31' and alternate pillow body 33 are made from different materials.

Figure 7:
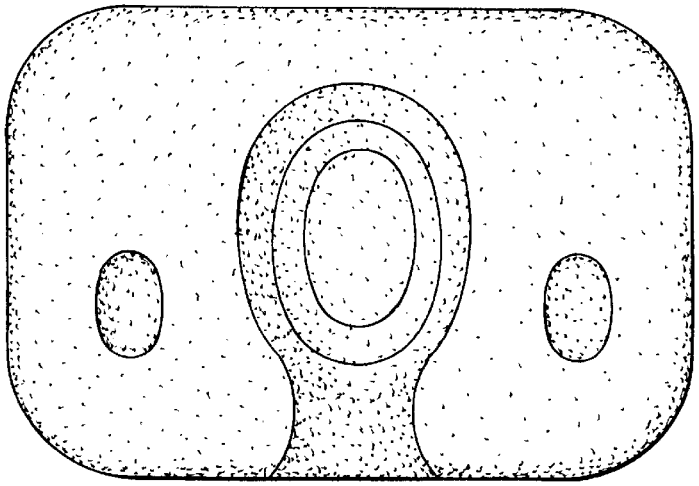
FIG. 7 is a top view of a rectangular pillow of the invention with two ear holes.
Figure 6:
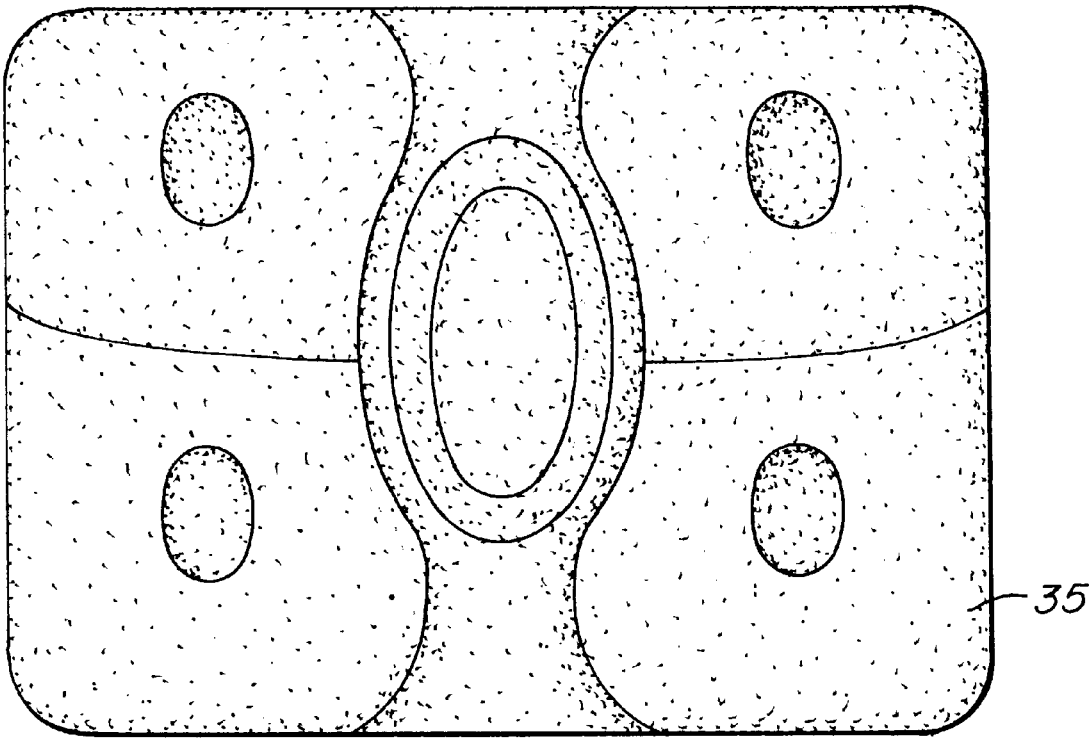
FIG. 6 is a top view of a rectangular pillow of the invention with four ear holes.

The exemplar pillows depicted in FIGS. 1–5 have an ovoid shape. While this shape is a preferred shape, other overall shapes are also desirable. FIGS. 6 and 7 depict alternate embodiments in which second alternate pillow body 3" and third alternate pillow body 3'" have a rectangular shape, wherein the corners of the rectangle are rounded. It will be appreciated that the overall shape of the pillow varies depending on the aesthetically preferred overall pillow shape for the end user. In addition, depending on the placement of the user's arms while asleep, certain overall shapes for the pillow are more comfortable for some users.

FIGS. 8–13 depict an additional preferred embodiment comprising a raised cervical support region with integral ear holes.

Figure 8:
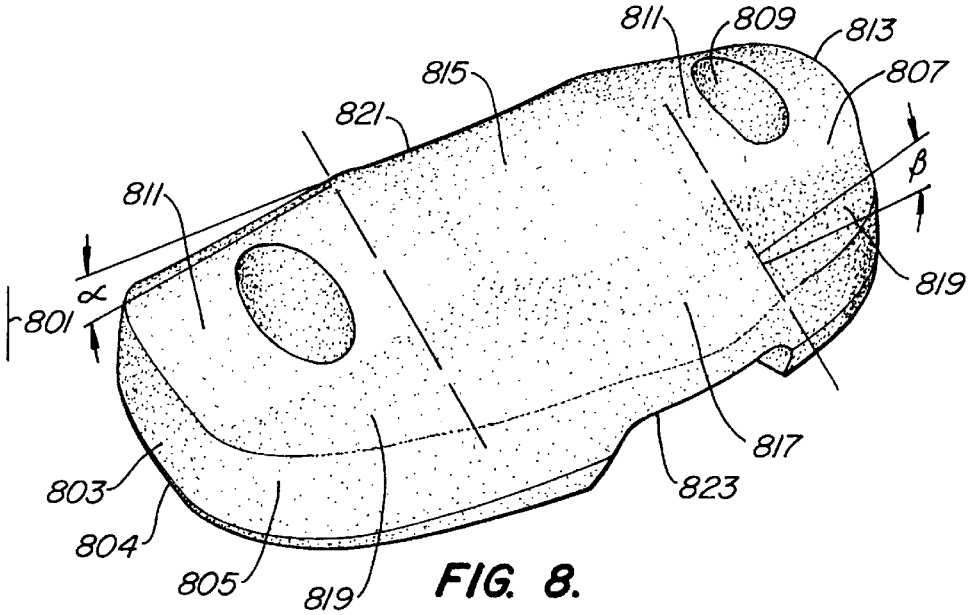
FIG. 8 is a top perspective view of an adjustable pillow with enhanced cervical support and two ear holes.
Figure 9:
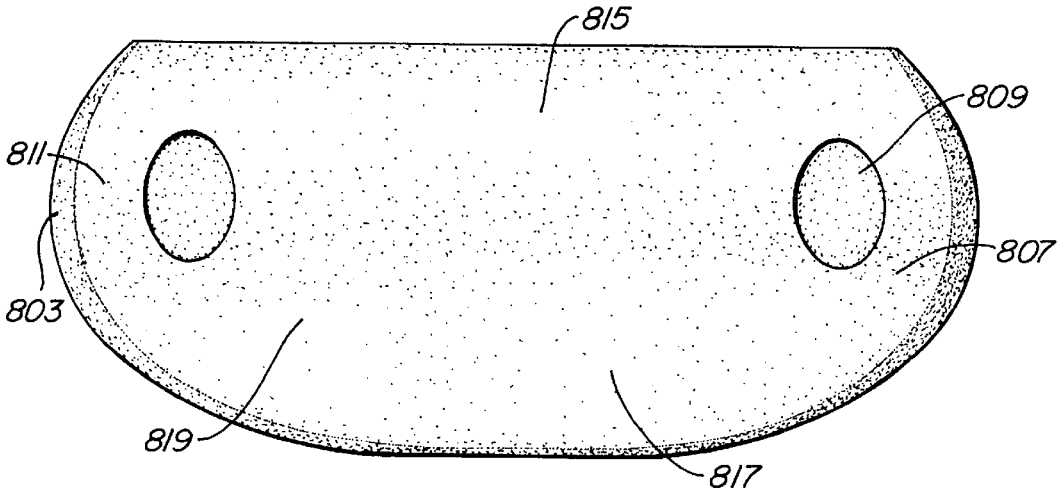
FIG. 9 is a top view of an adjustable pillow with enhanced cervical support and two ear holes.

FIG. 8 is a perspective illustration of a preferred exemplar embodiment for a cervical pillow of the invention with beautification properties for supporting the head and neck of a person. As described in more detail below, cervical beautification pillow 801 comprises resilient pillow body 803 with features for improving comfort and countering the effects of the natural ageing process in the skin of the user.

Adjustable pillow 801 comprises resilient pillow body 803 including resilient lower portion 804 and resilient upper portion 805 having top face 807 with at least one, and typically two or more ear depressions 809 for receiving the person's ears when the person is lying on their side. Top face 807 also includes one or more downward sloping ridge portions 811 with a downward angular planar declination angle α, measured from horizontal. This angle, as described supra, is typically between about 1 and 15°, i.e., downward sloping portion 811 of the pillow face slopes downward from the horizontal at angle α between about 1° and about 15°. In this embodiment, raised cervical support region 813 for supporting the neck and head of the user comprises central flat or inwardly sloping region 815 for supporting the user while lying supine (face up) as well as downward sloping planar portion 811 along the front of the pillow. In addition, top face 807 includes center head support region 817 which is flat or inwardly sloping and side head support regions 819 which slopes downward from horizontal at an angle β which is typically the same angle as α, although it optionally differs from α. Pillow 801 is shown oriented with front edge region 821 (the side of the pillow facing the user's body during typical use is the "front") and rear edge region 823. Raised cervical support region 813 is located proximal to front edge region 821. As shown, raised cervical support region 813 slopes down towards rear edge region 823 and additionally slopes toward the outer edges of the pillow at angle α.

Center support region 817 is optionally contoured to support the occipital region of the head when the user sleeps with their dorsal surface on the bed. The contour reduces pressure on the occipital condyle at the base of the skull, improving the comfort of the pillow, and reducing the incidence of headache. The contour in center support region 817 also reduces side to side movement of the head, aiding in relaxation of the neck. However, the sides of the contour are preferably at a moderate angle relative to the center of the contour (i.e., center support region 817 typically slopes into the center at a slight angle), permitting a user a moderate degree of freedom in moving their head from side to side. It will be appreciated that a full 90 degree angle to the sides of the contour more completely restricts side to side head motion. In some cases, e.g., where a user suffers from a neck injury, a greater restriction on side to side motion and a 90 degree angle to the sides of the contour is desirable.

Figure 10:
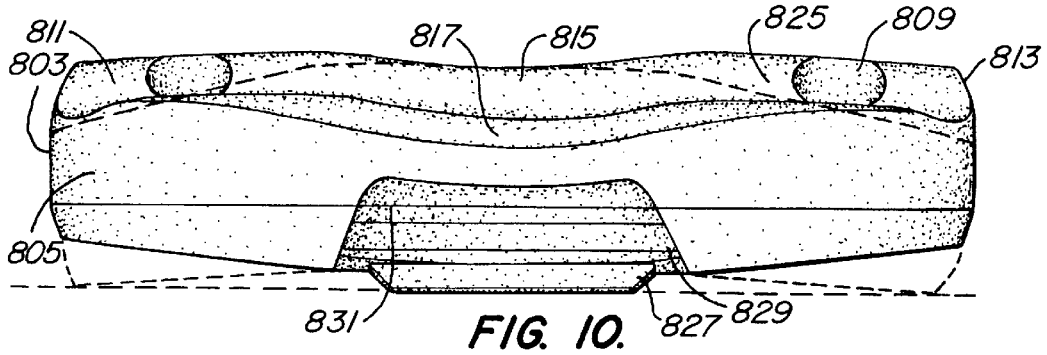
FIG. 10 is a rear view of an adjustable pillow with enhanced cervical support and two ear holes, showing head-neck adjustment shims.

As shown, ear depressions 809 are embedded in raised cervical support region 813. The arrangement of ear depressions 809 in reference to support region 813 is also depicted in FIG. 10. FIG. 10 is a rear view of pillow 801 (in use, the user's body rests on the opposite side of the pillow; see, FIG. 11). As shown, ear depressions 809 reside on rearward curve 825 of support region 813. In some embodiments, the ear depressions are located more towards the front or the rear of the pillow, to account for a user having a longer or shorter neck. It will be appreciated that the pillows of the invention are optionally sized or modified to accommodate particular users.

Downward sloping planar portion 811 with downward angular planar declination angle α provides the user with several benefits. For example, the appearance of morning wrinkles on the skin of the user's face due to stretching of the face from the weight of the user's head pressing ventrally downward are reduced, because the skin is not pulled ventrally. Instead, the skin and flesh on the users face is gently drawn in a dorsal direction, thereby offsetting the ventral pull of gravity and returning the skin on the user's face (e.g., around the skin and eyes) to a neutral position. Similarly, because the nasal passages are pulled slightly open by the gentle dorsal pull on the skin, rather than being pushed closed by the ventral pull of an ordinary pillow, sinus congestion is reduced. This prevents sinus infections and reduces snoring. Because airways are pulled open, obstructive sleep apnea (a potentially serious sleeping disorder often caused by the collapse of the central airways in overweight or elderly persons during sleep, causing sputtering, snorting and snoring during sleep) is reduced. Finally, because a user sleeping with their stomach on the surface of a bed does not have to turn their neck a full 90 degrees to rest their head on the pillow, neck and back strain are reduced. Typically, α is a gentle to moderate downward angle from the horizontal, varying between about 1 and about 15 degrees. More typically, α will be between about 2 degrees and about 6 degrees. Generally, α will be between about 3 degrees and about 5 degrees. For example, in one preferred embodiment, α is about 4 degrees.

Figure 12:
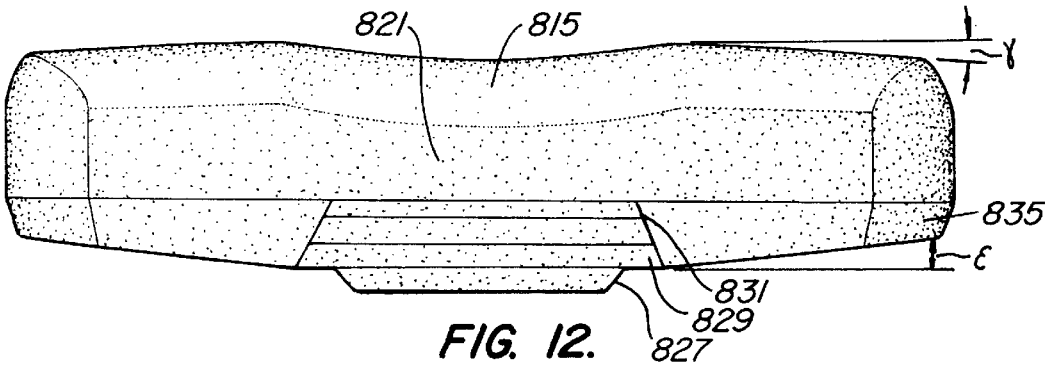
FIG. 12 is a front view of an adjustable pillow with enhanced cervical support.

FIG. 10 provides a rear view of pillow 801, while FIG. 12 provides a front view of the pillow. As shown, removable shims 829–831 sit under central flat or inwardly sloping region 815 of cervical support 813 for raising or lowering the height of a user's head while lying supine and for increasing or decreasing support on the cervical vertebrae when lying supine. The removable nature of shims 829–831 permits customization by the user. Optionally, shims 829–831 comprise means for re-attaching the shims in place, e.g., adhesive tape, Velcro or the like. Thus, a user can experiment with the number and arrangement of shims to optimize comfort during use.

Figure 13:
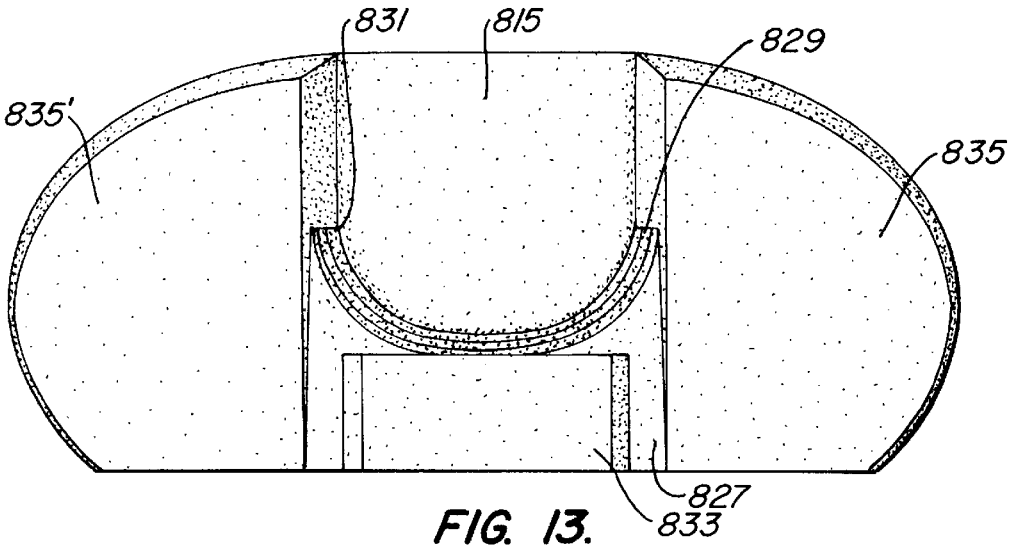
FIG. 13 is a bottom view of an adjustable pillow with enhanced cervical support showing removable head shims located under an upper resilient surface.

The arrangement of shims 829–831 is further depicted in FIG. 13, which is a bottom view of pillow 801. As shown, shims 829–831 are located between lower resilient region shims 835 and 835'. Lower resilient region shims 835 and 835' support pillow body 803. In addition, placement of lower resilient region shims 835 and 835' provides, in part, for cupping of the user's head while lying supine. In brief, as depicted, the bottom of central flat or inwardly sloping region 815 is not supported by lower resilient region shims 835 and 835'; accordingly, in use, the user's head depresses region 815, adding to the lateral stability of the user's head while lying supine (the sides of region 815 cup inward under pressure from the user's head on the region). It will be appreciated that shims 829–831 can be of different thicknesses and can extend more or less towards the rear of the pillow than depicted. Optionally, the length of cervical support as measured from the front towards the rear of the pillow can be modified based upon the shim configuration 829–831 depending upon the particular user. As discussed supra, a gentle pull or traction on the cervical region improves user comfort and reduces neck strain.

Figure 11:
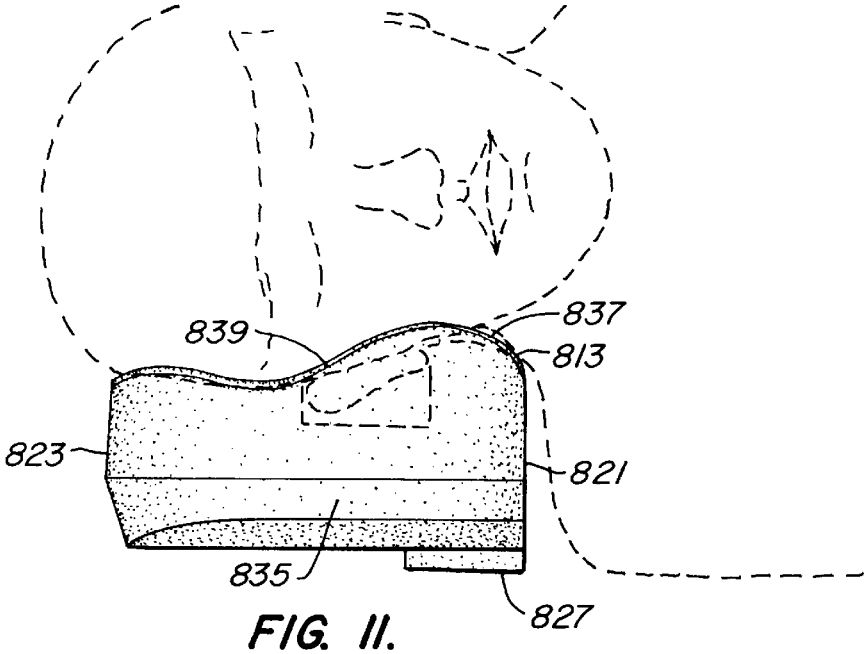
FIG. 11 is a cross-sectional view of an adjustable pillow with enhanced cervical support.

FIG. 11 is a side cutaway view of pillow 801 showing further details of the slopes of raised cervical region 813. As shown, raised cervical region 813 includes front sloping portion 837 which slopes towards front region 821, as well as rear sloping region 839 which slopes toward rear region 823.

FIG. 12 is a rear view of pillow 801 which illustrates component elements providing downward sloping planar portion 811 with downward angular planar declination angle $\alpha$. As shown, downward sloping planar portion 811 is molded to have a slight downward angle ($\gamma$). In addition, lower resilient region shims 835 and 835' are molded to have a slight upward angle ($\zeta$). In use, pressure from the user on the top of pillow 801 causes the pillow to conform to, e.g., a horizontal bed surface. This causes downward sloping planar portion 811 to have a downward slope at angle $\alpha$ which is the sum of $\gamma$ and $\zeta$. It will be appreciated that $\alpha$ can also be equal to either $\gamma$ or $\zeta$, i.e., where $\alpha$ is provided solely by either $\gamma$ or $\zeta$. In other words, downward slopes slope downward as a function of the angle of the top of a pillow, or as a function of the slope of a bottom portion of a pillow, or both.

In certain embodiments, an absorptive pillow covering is used to encase the pillows described above. For example, cotton, flannel, synthetic fabric, or bactericidally treated fabric (e.g., STAPH CHECK® available from Kees Goebel Medical, Hamilton, Ohio) can be fastened (e.g., using VELCRO® (available from a variety of manufacturers), soft zippers or buttons), sewn or glued to the pillow body. Alternatively, certain preferred classes of polyurethane foams such as TEMPER FOAM® (originally developed by NASA, and available, e.g., from Kees Goebel Medical, Hamilton, Ohio) optionally comprise an adhesive surface (e.g., TEMPER STICK®, also available from Kees Goebel) for attachment of the absorptive pillow covering. Optionally, the absorptive covering is shaped to conform to the features of pillow body, such as ear depressions, raised cervical support regions or the like. In these embodiments, the absorptive covering can be extended around the pillow body, or a portion thereof (typically the upper resilient portions and particularly the top face).

The absorptive covering optionally includes openings for placement of head height adjustment shims and pillow body adjustment shims. For example, the absorptive covering optionally comprises an opening in central depression 15 for placement of top head height adjustment shim 17, intermediate head height adjustment shim 19 and lower head height adjustment shim 21 within the absorptive covering, and/or optionally comprises an opening permitting access to bottom face 27 for placement of pillow height adjustment shim 29 within the absorptive covering. Alternatively, the absorptive covering can conform to pillow body 3, with shims optionally having a similar absorptive covering.

The pillows described above are typically placed in a pillow case for use to improve the hygienic qualities of the pillow during use. It will be appreciated that pillow cases are easily cleaned. The pillow case is preferably loosely fitted around the pillow (particularly the top of the pillow) e.g., so that the user's ear can fit into ear depressions without interference by the pillow case. The pillow case can be made from essentially any standard pillow case material, with cotton, polyester, cotton-polyester blends and particularly silk being most preferred. The pillow case is typically separate from the absorptive covering described above, and in one class of embodiments, pillows are encased in both an absorptive covering and a pillow case.

Clinical Sleep Trial

The pillows of the invention were tested at the Stanford University Sleep Disorders Clinic (Palo Alto, Calif.) for effects on patient populations suffering from snoring and sleep apnea. The pillows successfully reduced snoring and sleep apnea events in patients having light sleep apnea. Patients having severe sleep apnea were not significantly improved, except that they were able to sleep more comfortably. Patients reported increased comfort and improved sleep quality.

All publications, patents and patent applications cited in this specification are herein incorporated by reference for all purposes as if each individual publication patent or patent application were specifically and individually indicated to be incorporated by reference.

Although the foregoing invention has been described in some detail by way of illustration and example for purposes of clarity of understanding, it will be readily apparent to those of ordinary skill in the art in light of the teachings of this invention that certain changes and modifications may be made thereto without departing from the spirit or scope of the appended claims.

What is claimed is:

1. A pillow for supporting the head and neck of a person, comprising:

a resilient pillow body (1; 801) with a central depression (17), at least one head adjusting shim (19; 21; 23; 827; 829; 830), and a resilient upper portion (5; 805) comprising a plurality of depressions (9; 809) on a top face (7; 807) of the resilient upper portion for receiving a person's ear during use, the resilient pillow body having a front edge region (821) and a rear edge region (823);

said top face comprising a raised cervical support region (13; 813) for supporting the neck of a user during use; and, said resilient pillow body having a resilient lower portion (27, 804) with a bottom face (29).

2. The pillow of claim 1, wherein the raised cervical support region is located proximal to the front edge of the pillow body.

3. The pillow of claim 1, wherein the raised cervical support region is located proximal to the front edge of the pillow body and comprises a central flat or inwardly curving region.

4. The pillow of claim 1, wherein the raised cervical support region comprises a downward sloping ridge region (11) which slopes downward from a center region of the raised cervical support region along the top face at the front edge region of the pillow.

5. The pillow of claim 1, wherein the plurality of depressions are located on a portion of the raised cervical support region.

6. The pillow of claim 1, wherein at least one of the plurality of depressions (809) is located on a rearward face (825) of the raised cervical support region, thereby providing support for the neck of the person when an ear of the person is positioned in the at least one depression.

7. The pillow of claim 1, wherein at least one of the plurality of depressions (809) is located on a rearward face (825) of the raised cervical support region, thereby providing support for the neck of the person when an ear of the person is positioned in the at least one depression, wherein the rearward face of the raised cervical region slopes downward towards the rear of the pillow and additionally slopes downward toward an outer edge of the pillow.

8. The pillow of claim 1, wherein the pillow comprises one or more removable shims (827; 829; 831) under the raised cervical support region for increasing pressure on the cervical region during use.

9. The pillow of claim 1, wherein the pillow comprises about three removable shims (827; 829; 831) under the raised cervical support region for increasing pressure on the cervical region during use.

10. The pillow of claim 1, wherein the pillow comprises about three removable shims (827; 829; 831) under the raised cervical support region for increasing pressure on the cervical region during use, which about three shims are of different dimensions.

11. The pillow of claim 1, wherein the pillow comprises a plurality of overall pillow height adjustment shims (835, 835') under an outer portion of the pillow body, which shims support the pillow body during use, which shims do not support a central portion of the pillow body, thereby providing a depressible central region which is depressed by the person's head during use.

12. The pillow of claim 1, wherein the resilient upper portion is composed of a first polyurethane foam, and the resilient lower portion is composed of a second polyurethane foam, which second foam is different from said first foam.

13. The pillow of claim 1, wherein the top surface of the resilient upper portion comprises a rounded edge around the circumference of the pillow.

14. The pillow of claim 1, wherein the pillow body is molded from polyurethane using a molding process selected from the group consisting of cavity molding, and free-rise molding.

15. The pillow of claim 1, wherein the top surface of the upper resilient portion is die-cut from a resilient polyurethane foam blank.

16. The pillow of claim 1, further comprising an absorptive pillow covering encasing the pillow body.

17. A method of making a cervical pillow with beautification properties for supporting the head and neck of a person, comprising the steps of:

forming a resilient pillow body (3; 803) with a central depression (17), at least one head adjusting shim (19; 21; 23; 827; 829; 830), and a resilient upper portion (5; 805) comprising a plurality of depressions (9; 809) on a top face (7; 807) of the resilient upper portion for receiving a person's ear;

shaping said top face to comprise a raised cervical support region (13; 813) for supporting the neck and head of a user during use; and, shaping said resilient pillow body to have a resilient lower portion (27; 804) with a bottom face (29).

18. The method of claim 17, wherein the resilient pillow body is formed from polyurethane using a pillow body forming process selected from the group consisting of injection molding, cavity molding, die cutting, and hand cutting.

* * * * *